US005908083A

United States Patent [19]

Hamilton

[11] Patent Number: 5,908,083

[45] Date of Patent: Jun. 1, 1999

[54] ADJUSTABLE ROOFWORKER SUPPORT STRUCTURE

[76] Inventor: David L. Hamilton, 1913 Erie St., Racine, Wis. 53402

[21] Appl. No.: 09/059,225

[22] Filed: Apr. 13, 1998

[51] Int. Cl.[6] ..... E06C 7/48

[52] U.S. Cl. ..... 182/45; 182/206

[58] Field of Search ..... 182/45, 129, 206; 248/237

[56] References Cited

U.S. PATENT DOCUMENTS

| | | | |
|---|---|---|---|
| 530,165 | 12/1894 | Donovan . | |
| 599,963 | 3/1898 | Hatch . | |
| 1,142,694 | 6/1915 | Gilbert . | |
| 1,340,492 | 5/1920 | Melanson . | |
| 1,392,153 | 9/1921 | Hawkins . | |
| 2,341,510 | 2/1944 | Born . | |
| 2,623,794 | 12/1952 | Osten | 304/20 |
| 3,292,734 | 12/1966 | Swanberg | 182/45 |
| 3,842,934 | 10/1974 | Bartlett | 182/37 |
| 4,179,011 | 12/1979 | Morawski | 182/45 |
| 4,311,207 | 1/1982 | Lurry | 182/206 |
| 4,458,783 | 7/1984 | Stakes | 182/206 |
| 4,787,478 | 11/1988 | Stakes | 182/206 |
| 5,513,826 | 5/1996 | Lebaron | 248/237 |

FOREIGN PATENT DOCUMENTS

| | | | |
|---|---|---|---|
| 3445682 | 6/1986 | Germany | 182/45 |
| 3709441 | 10/1988 | Germany | 182/45 |
| 115453 | 4/1990 | Japan | 182/45 |
| 404166556 | 6/1997 | Japan | 182/45 |
| 2190420 | 11/1987 | United Kingdom | 182/45 |

*Primary Examiner*—Alvin Chin-Shue
*Attorney, Agent, or Firm*—Jansson, Shupe, Bridge & Munger, Ltd.

[57] ABSTRACT

Improved roofworker support apparatus for placement on slanted roof structures with varying peak angles, and including a pair of peak-adjustable elongate assemblies independently deployable on the roof structure in spaced substantially parallel positions extending up the roof, each including and at least one elongate crosspiece removably supportable across the elongate assemblies. The elongate assemblies include an elongate roof-contact member, and overpeak member, an adjustment member between the overpeak member and the roof-contact member and adjustable to set the elongate roof-contact member and overpeak member at desired angle to accommodate roof peak angles, and at least one crosspiece-support member affixed to the elongate roof-contact member. Highly preferred embodiments include certain extension members.

18 Claims, 8 Drawing Sheets

ADJUSTABLE ROOFWORKER SUPPORT STRUCTURE

FIELD OF THE INVENTION

This invention relates to apparatus to facilitate support of workers on slanted roof structures during roofing or other work and, more particularly, to elongate devices placed on, and running up, slanted roof surfaces to and over the roofpeaks to hold cross-pieces used for support by roofworkers.

BACKGROUND OF THE INVENTION

Roofworkers, particularly those working on slanted roofs, are at risk of falling from their worksites to the ground. For that reason, particular precautions are often exercised and some devices have been developed to lessen the risks.

Some prior patents disclose some of the efforts of the past to provide support for roofworkers. Typically, such devices assume a standard roof with opposing tilted flat surfaces extending upwardly until they form a roofpeak. Roofworkers engaged in installing roof shingles, or in performing other tasks on the roof, have used various devices which provide a place to securely stand on one's feet.

Most typically, roofers use devices which must be nailed or tacked into the roof structure to provide a means of support for standing. Such devices, often called toe-holds, require significant time to install and to remove and reinstall, in part because of the need to nail such devices to the roof structure. Use of them is far too time-consuming and inefficient, and improper use raises safety concerns.

A variety of other devices which extend up the roof toward the peak and over it have also been used, but these too have disadvantages. These will now be discussed.

Several prior patents disclose various up-the-roof devices in the form of ladders or the like having adjustable over-the-peak members. Among these are U.S. Pat. Nos. 2,341,510 (Born), 4,311,207 (Lurry), 4,458,783 (Stakes) and 4,787,478 (Stakes). Each of these devices has roofpeak adjustment members which serve to facilitate full contact with the roof structure surface—and thus enhance stability. These devices also are quite wide like ladders, and are often heavy and difficult to use. By virtue of their ladder-like qualities, such devices are not easily moved; nor do they provide more than limited working area range without moving them repeatedly.

Certain other prior patents disclose pairs of independent up-the-roof members used to support devices on the roof. Among these are U.S. Pat. Nos. 3,842,934(Bartlett), 5,513,826 (Lebaron), and 3,292,734 (Swanberg). Such devices, however, do not include peak-adjustment capability to provide stability regardless of the particular roofpeak angle involved.

In short, roofworker support apparatus of the prior art have a number of disadvantages and shortcomings, including bulkiness and weight which make an apparatus difficult to put in place and relocate, lack of stability, lack of versatility, difficulty of use because of the need to repeatedly attach, remove and reattach using nails.

There is a need for an improved, simple, easily usable, versatile roofworker support apparatus.

OBJECTS OF THE INVENTION

It is an object of this invention to provide improved roofworker support apparatus overcoming the problems and shortcomings of the prior art.

Another object of this invention is to provide an easily-deployable roofworker support apparatus.

Another object of this invention is to provide a versatile roofworker support apparatus, which is easily moved.

Another object of this invention is to provide an easily-deployable roofworker support apparatus which is easily adaptable to varying roofpeak angles.

BRIEF SUMMARY OF THE INVENTION

This invention is an improved roofworker support apparatus for placement on slanted roof structures with varying peak angles. The apparatus is easily deployable, highly versatile and yet very stable on roofs of various angles, and does not require nailing or other such attachment to the roof structure. Ease of deployment is also related to the fact that the invention includes a pair of elongate assemblies which are independently deployable on the roof structure. Such assemblies are deployed in substantially parallel positions extending up the roof in any reasonable spacing as selected by the user. One or more elongate crosspieces, such as 2×6 boards are removably supportable by gravity across the independently-deployed elongate assemblies to provide roofworker support at positions between the elongate assemblies.

More specifically, the roofworker support apparatus of this invention includes a pair of elongate assemblies independently deployable on the roof structure in spaced substantially parallel positions extending up the roof and at least one elongate crosspiece removably supportable across the elongate assemblies by gravity at selected positions, thereby to provide roofworker support at positions between the elongate assemblies.

Each of such elongate assemblies includes: an elongate roof-contact member having lower, middle and upper portions and a substantially planar roof-contact surface extending therealong; an overpeak member pivotably secured to the upper portion at a first pivot axis and having roof-contact and free-end portions on opposite sides of the first pivot axis; an adjustment member having one end secured to the free end of the overpeak member and an opposite end secured to the elongate roof-contact member, the securement of the adjustment member being adjustable such that the elongate member and overpeak member can be set at desired angles to accommodate roof peak angles; and at least one crosspiece-support member (preferably several spaced apart) affixed to the elongate roof-contact member, to receive the crosspiece or crosspieces at the selected position (s).

In preferred embodiments, the adjustment member is pivotably secured to the free end of the overpeak member at a second pivot axis. The upper portion of the elongate roof-contact member preferably has a plurality of anchorholds thereon for selected securement with the opposite end of the adjustment member to adjust the apparatus to the peak angle. Each anchorhold is positioned to accommodate a particular roof pitch.

In preferred embodiments, the anchorholds are formed by an anchor member secured to the upper portion of the elongate roof-contact member at a position spaced from the first pivot axis in a direction toward the middle portion. The anchor member preferably has rod-receiving holes in it spaced therealong to form the anchorholds, and the opposite end of the adjustment member has a rod transverse to the elongate roof-contact member and engageable in a selected rod-receiving hole, to set the apparatus for the peak angle on the roof being serviced.

Properly adjusted, both the elongate roof-contact member and the roof-contact portion of the overpeak member will be in full contact with the surface of the roof. This is desirable to give substantial stability, and it is unnecessary to nail any portion to the roof structure to obtain sufficient stability for roofworker safety.

In highly preferred embodiments, the roof-contact portion of the overpeak member defines an overpeak roof-contact surface which is substantially planar. This adds stability to the roofworker support apparatus.

In certain preferred embodiments, there are a plurality of crosspiece-support members spaced along the middle and lower portions of the elongate roof-contact member to provide a number of locations for placement of the crosspieces(s). In highly preferred embodiments, one of the crosspiece-support members is a lowermost crosspiece-support member on the lower portion of the roof-contact member, and such lowermost crosspiece-support member includes an extension-securement member.

The roofworker support apparatus of this invention preferably also includes an extension assembly for each elongate assembly, such extension assemblies themselves having one or more additional crosspiece-support members affixed thereto. Such extension assemblies in effect extend the elongate assemblies closer to the eave of the roof. Such extensions assemblies preferably include an extension-roof-contact member extending therealong and a top end attachable to the extension-securement member at the lower end of the elongate assembly.

In such embodiments, it is preferred that the extension-securement member include a pin-receiving hole in the lowermost crosspiece-support member and a securement pin therein. In such embodiments, it is also preferred that the extension assembly itself include a connection-support member at the top end thereof affixed to the extension-roof-contact member, and that the connection-support member have a pin-receiving opening which is alignable with the pin-receiving hole in the lowermost crosspiece-support member while the extension-roof-contact member is in full contact with the roof. Thus, addition of the extension assembly adds further stability to the device while increasing the number of positions for crosspieces.

In highly preferred embodiments, the overpeak member also has apparatus on it for attachment of an extension assembly to extend down the overpeak side of the roof. In such preferred embodiments, the roof-contact portion of the overpeak member has a distal end portion which includes an extension-attachment member, and the top end of the extension assembly is attachable thereto.

In such embodiments, it is preferred that the extension-attachment member on the overpeak member include a pin-receiving hole in the distal end portion of the overpeak member and an attachment pin therein. To mate with this, it is preferred that the extension assembly have a pin-receiving slot on it defined between the extension-roof-contact member and the connection-support member affixed thereto, and that the pin-receiving slot receive the attachment pin with the extension-roof-contact member in full contact with the overpeak side of the roof. Thus, addition of such extension assembly on the overpeak side of the roof adds further stability to the device while providing one or more positions for crosspieces on the overpeak side of the roof.

The top end configuration of the extension assembly preferably has both the aforesaid pin-receiving openings and the aforesaid slot such that the extension assembly can be firmly secured to either the elongate assembly on the first side of the roof or to the overpeak member on the overpeak side of the roof.

In highly preferred embodiments, each of the crosspiece-support members includes an upright board support and the crosspiece is a board, preferably a 2×6 wooden board supported by gravity against the crosspiece-support member and elongate roof-contact member.

In certain preferred embodiments, one or more of the crosspiece-support members has a safety-harness-connection opening therein. This allows a rope-like safety harness to be connected to the device.

In certain highly preferred embodiments, the roofworker support apparatus includes a roller at its upper end to facilitate relocation of the device in certain circumstances. A roofworker would use such roller by holding the elongate roof-contact member at its middle or lower portion and supporting its upper portion on the roof by means of such roller. However, it should be pointed out that the weight of the elongate roof-contact member is light enough that location and relocation can be done with ease in any event.

DETAILED DESCRIPTION OF PREFERRED EMBODIMENTS

Figure 1:
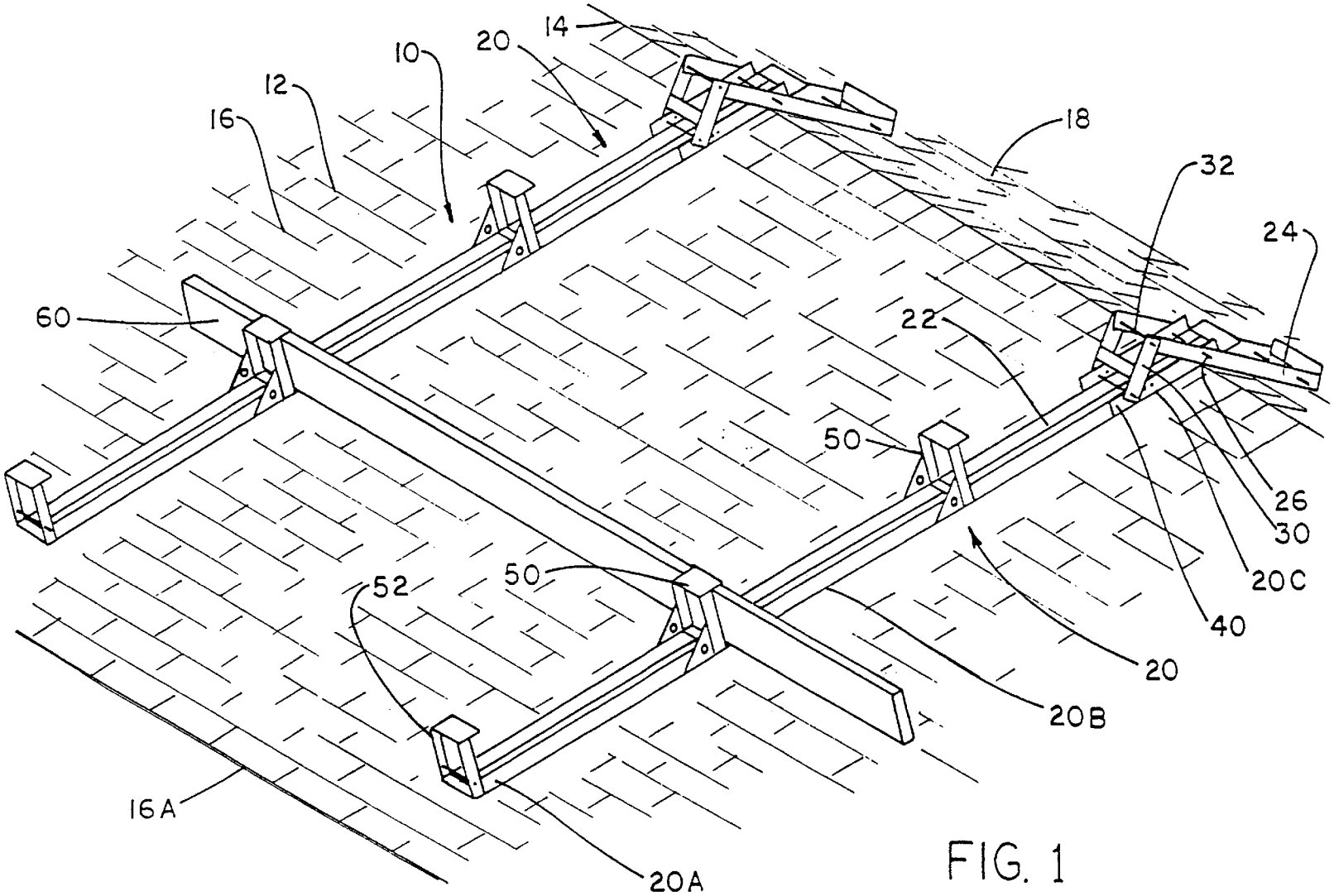
FIG. 1 is a perspective view of a roof having the roofworker support apparatus of the invention on it.

The figures illustrate a roofworker support apparatus 10 in accordance with this invention. FIG. 1 shows roofworker support apparatus 10 on a roof structure 12 of the sort which includes roofpeak 14 and two angled sides, including a first roof side 16 and a second roof side (or "overpeak side") 18. First side 16 terminates downwardly in an eave 16A.

Roofworker support apparatus 10 includes a pair of independently deployable elongated assemblies 20 and one or more elongate crosspieces 60, which are preferably 2×6 pieces of lumber.

Figure 2:
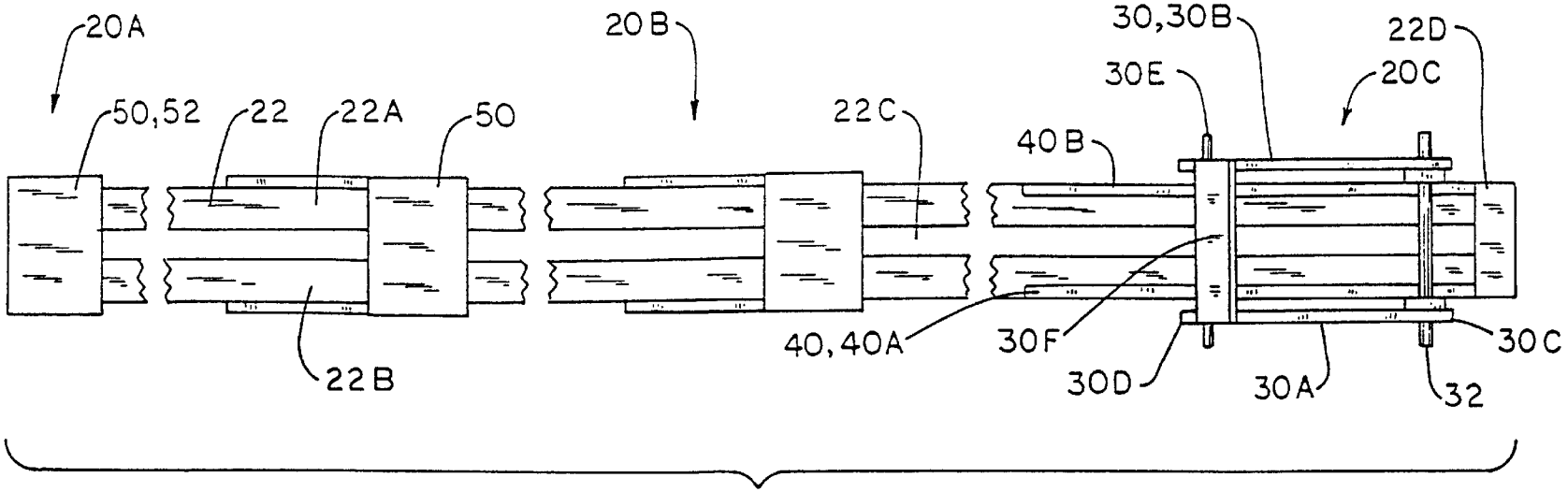
FIG. 2 is a plan view of the roofworker support apparatus with breakaway portions.
Figure 3:
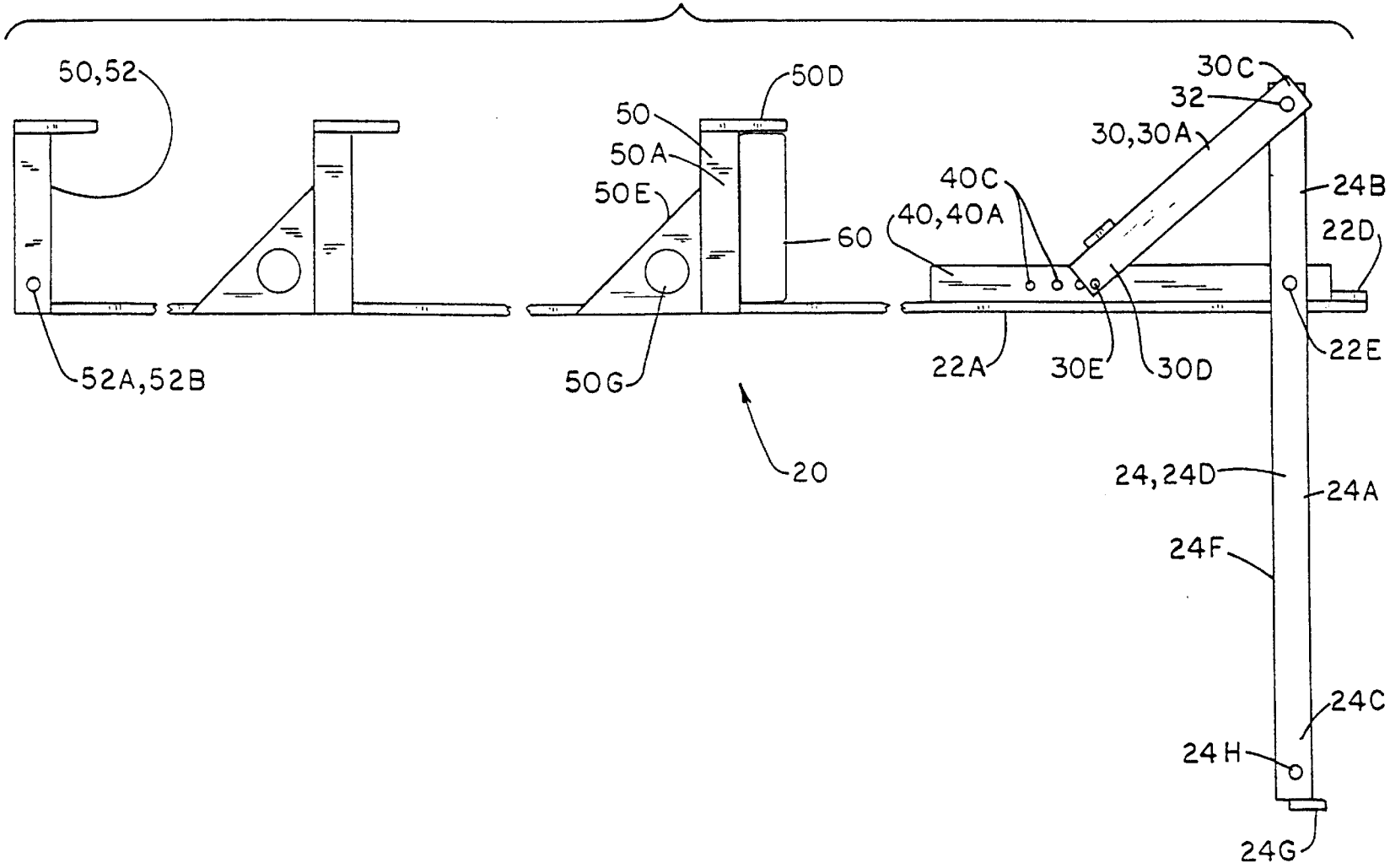
FIG. 3 is a side elevation of FIG. 2.
Figure 4:
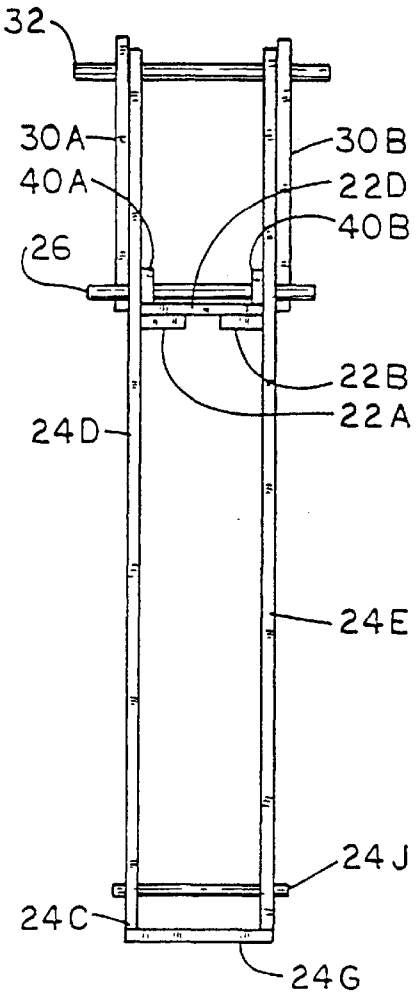
FIG. 4 is a right side elevation of FIG. 3.

As shown best in FIGS. 2 and 3, each elongate assembly 20 includes a lower portion 20A, middle portion 20B and upper portion 20C. As shown in FIGS. 2–4, each elongate assembly 20 includes first and second elongate flat pieces 22A and 22B. Flat pieces 22A and 22B are attached by means of an upper-end crosstie 22D and a number of crosspiece-support members 50 (hereafter described) attached along the length of first and second elongate flat pieces 22A and 22B. Flat pieces 22A and 22B are spaced apart by such interconnection to form a gap 22C therebetween. Gap 22C allows elongate roof-contact member 22 to be lighter in weight than would otherwise be the case, and also to have sufficient width to provide good stability on the roof structure. First and second flat pieces 22A and 22B together form a substantially planar roof-contact surface 22F, which also serves to enhance stability.

Elongate assembly 20 includes an upper-end pivot point 22E (the placement of which is hereafter described in more detail) for pivot attachment of an overpeak member 24 (hereafter described) with respect to upper portion 20C—that is, with respect to elongate roof-contact member 22. Such pivot attachment at pivot point 22E is by means of a first pivot pin 26 along a first pivot axis.

Elongate assembly 20 also includes overpeak member 24 which, as just noted, is pivotably-mounted with respect to elongate roof-contact member 22. Overpeak member 24 includes a roof-contact portion 24A and a free-end portion 24B on opposite sides of first pivot pin 26 and first pivot axis.

Overpeak member 24 is formed of first and second overpeak sidepieces 24D and 24E which are spaced from one another. Sidepieces 24D and 24E have pin-receiving holes in them to receive first pivot pin 26 for the pivot attachment already mentioned. Sidepieces 24D and 24E extend the full length of overpeak member 24 and thus form parts of both roof-contact portion 24A and free-end portion 24D. Roof-contact portion 24A provides a planar overpeak roof-contact surface 24F, such planar surface 24F being formed by the undersides of sidepieces 24D and 24E.

Roof-contact portion 24A includes a distal end portion 24C, formed by portions of sidepieces of 24D and 24E. Distal end portions 24C have pin-receiving holes 24H therein by which an attachment pin 24J is secured between sidepieces 24D and 24E. Attachment pin 24J is used for attachment of an extension assembly (hereafter described).

Also extending between sidepieces 24D and 24E and affixed thereto is a distal-end crosspiece 24G. As shown in FIG. 3, such crosspiece 24G is offset in its position of attachment with respect to sidepieces 24D and 24E, for a purpose hereafter explained relating to facilitating attachment of the aforementioned extension assembly to overpeak member 24.

Elongate assembly 20 also includes an adjustment member 30 having a first end 30C pivotably secured to free end 24B of overpeak member 24 and an opposite end 30D adjustably secured to an anchor 40 (hereafter described) on elongate roof-contact member 22, as hereafter described. Adjustment member 30 is formed of first and second adjustment-member sidepieces 30A and 30B which are held in spaced parallel positions by an adjustment-member crosstie 30F (see FIG. 3) affixed therebetween. The pivotable securement of first end 30C to free end 24B is by means of a second pivot pin 32 along a second pivot axis.

The adjustable securement of opposite end 30D of adjustment member 30 to anchor 40 is as follows: Upper portion 20C of elongate roof-contact member 22 has first and second anchor sidepieces 40A and 40B affixed to the top sides of first and second elongate flat pieces 22A and 22B, respectively. First and second anchor sidepieces 40A and 40B have five pairs of aligned rod-receiving holes 40C (or "anchorholds") therein, and opposite end 30D of adjustment member 30 has a transverse rod 30E removably extending between first and second adjustment-member sidepieces 30A and 30B for engagement of adjustment member 30 with a selected pair of rod-receiving holes 40C. In this manner, the angle between elongate roof-contact member 22 and overpeak member 24 may be set to match the angle of roofpeak 14, and thus assure stability of elongate assembly 20 on roof structure 12.

Elongate assembly 20 also includes a number of crosspiece-support members 50 affixed to elongate roof-contact member 22 in positions spaced therealong. Crosspiece-support members 50 are identical to each other except that a lowermost crosspiece-support member 52 is a slight variation, for hereafter described.

Figure 5:
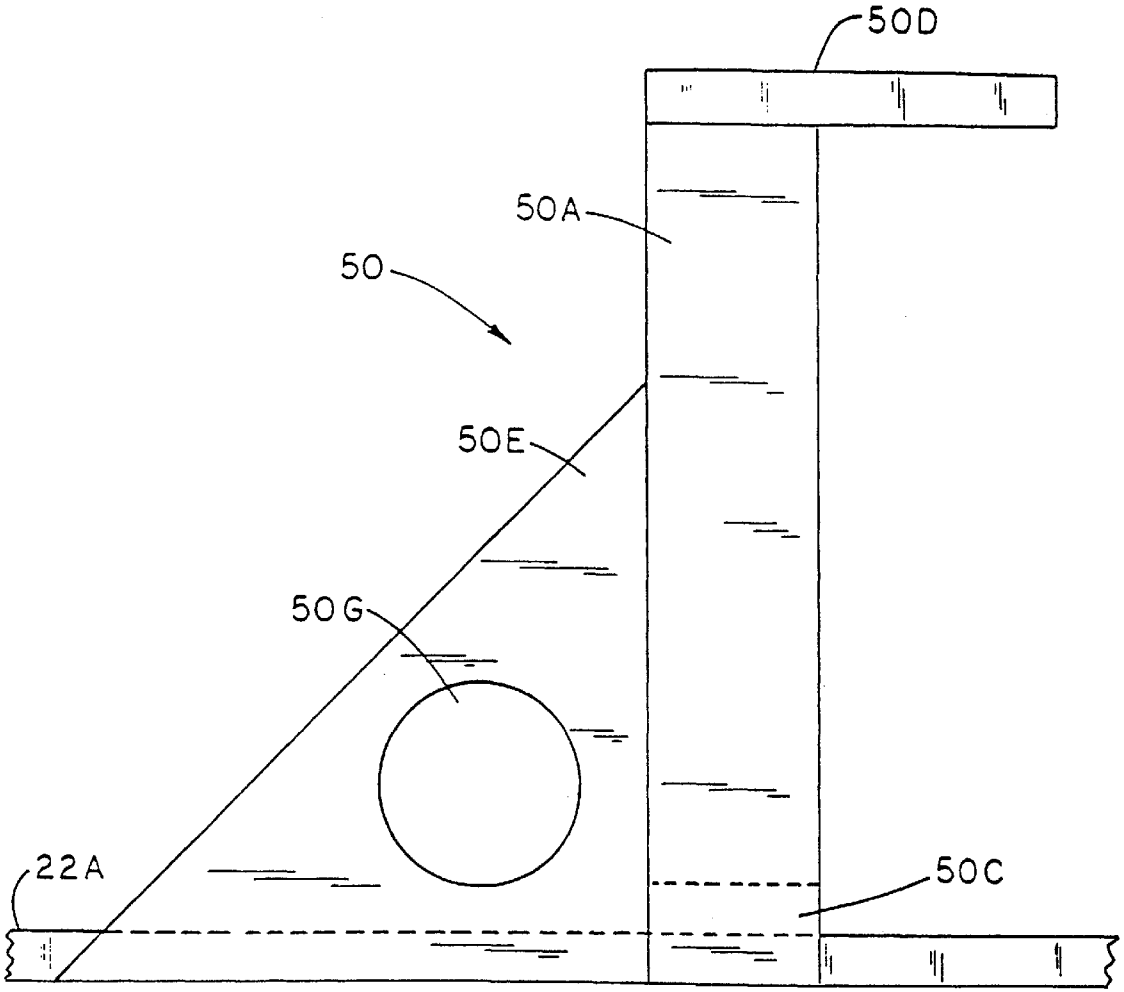
FIG. 5 is an enlarged fragmentary view of a portion of FIG. 3, illustrating a crosspiece-support member.
Figure 6:
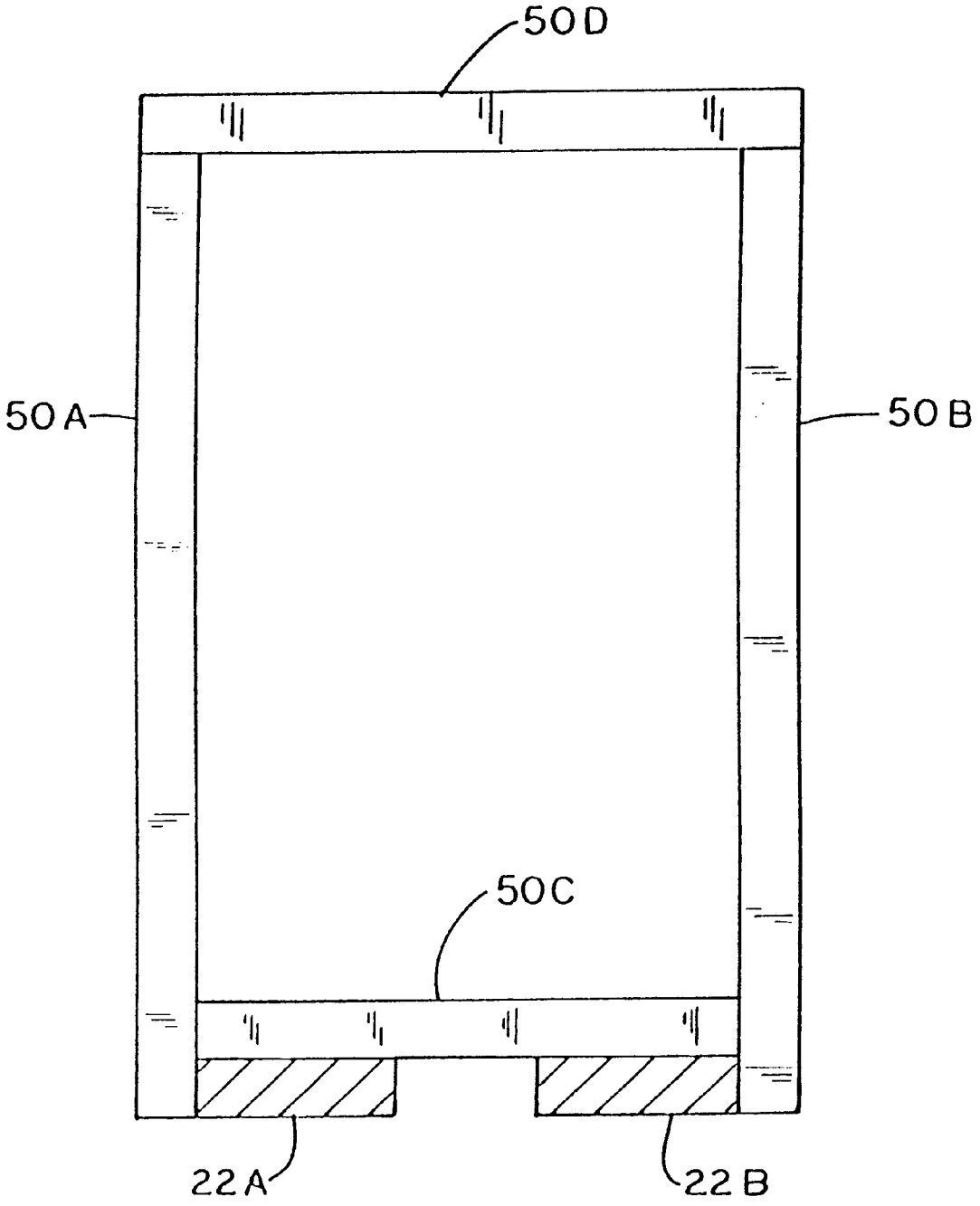
FIG. 6 is right side elevation of FIG. 5.

Crosspiece-support members 50, which are illustrated best in FIGS. 5 and 6, include first and second upright board supports 50A and 50B and aligned first and second gussets 50E and 50F all of which are affixed to first and second elongate flat pieces 22A and 22B, respectively. A crosstie 50C is affixed between board supports 50A and 50B and across flat pieces 22A and 22B, and a crosstop member 50D is affixed across the tops of upright board supports 50A and 50B. Crosstop member 50D extends outwardly beyond the upright board supports and is spaced above flat pieces 22A and 22B by a distance accommodating placement of one end of an elongate 2×6 crosspiece therebetween, to be held there by gravity and/or by being wedged therebetween. Gussets 50E and 50F have safety-harness-connection openings 50G therein to accommodate a rope-like safety harness (not shown).

Lowermost crosspiece-support member 52 is identical to the other crosspiece-support members except that it does not have gussets aligned with its upright board support members. Furthermore, its upright board support members have pin-receiving holes 52A therein near the point of attachment with flat pieces 22A and 22B. Extending removably through pin-receiving holes 52A is a securement pin 52B which is used for attachment of an extension assembly as hereafter described.

Figure 8:
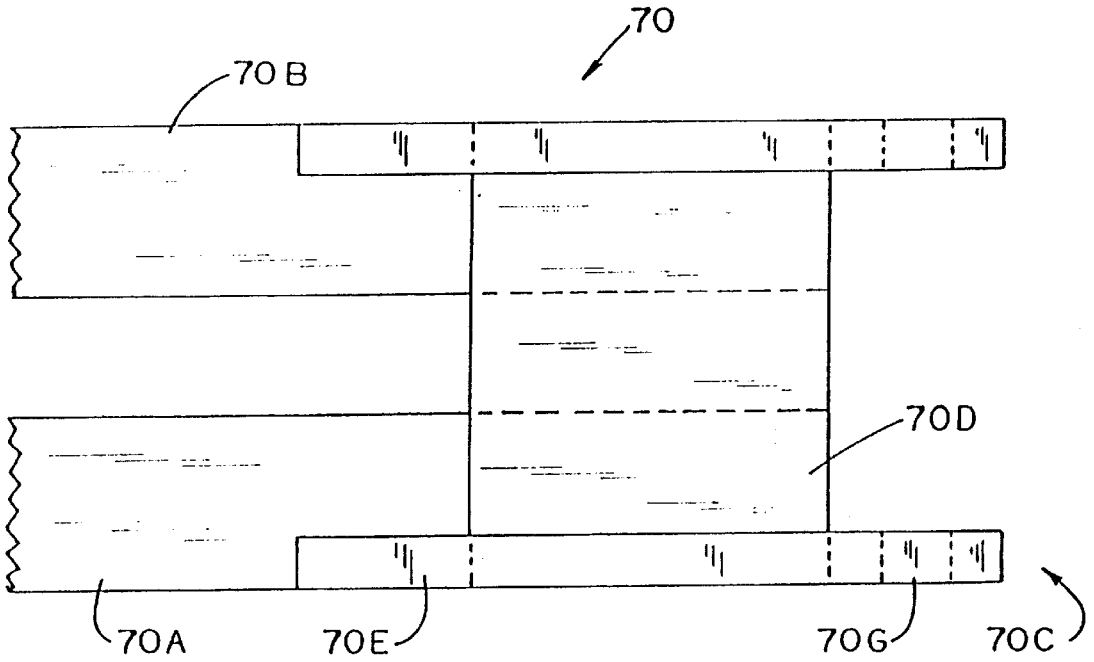
FIG. 8 is a top plan view of FIG. 7.
Figure 7:
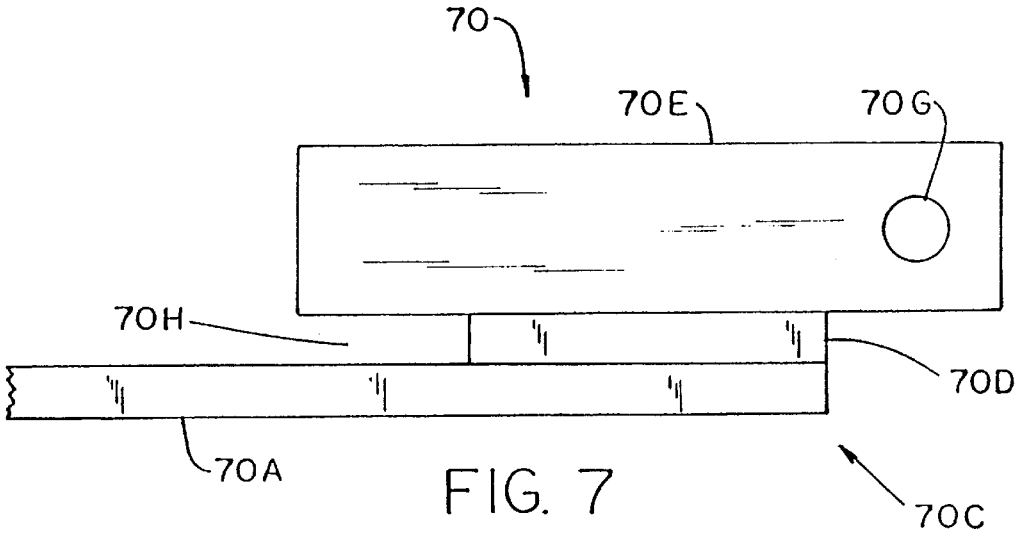
FIG. 7 is an enlarged fragmentary side elevation of the top end portion of an extension assembly.
Figure 9:
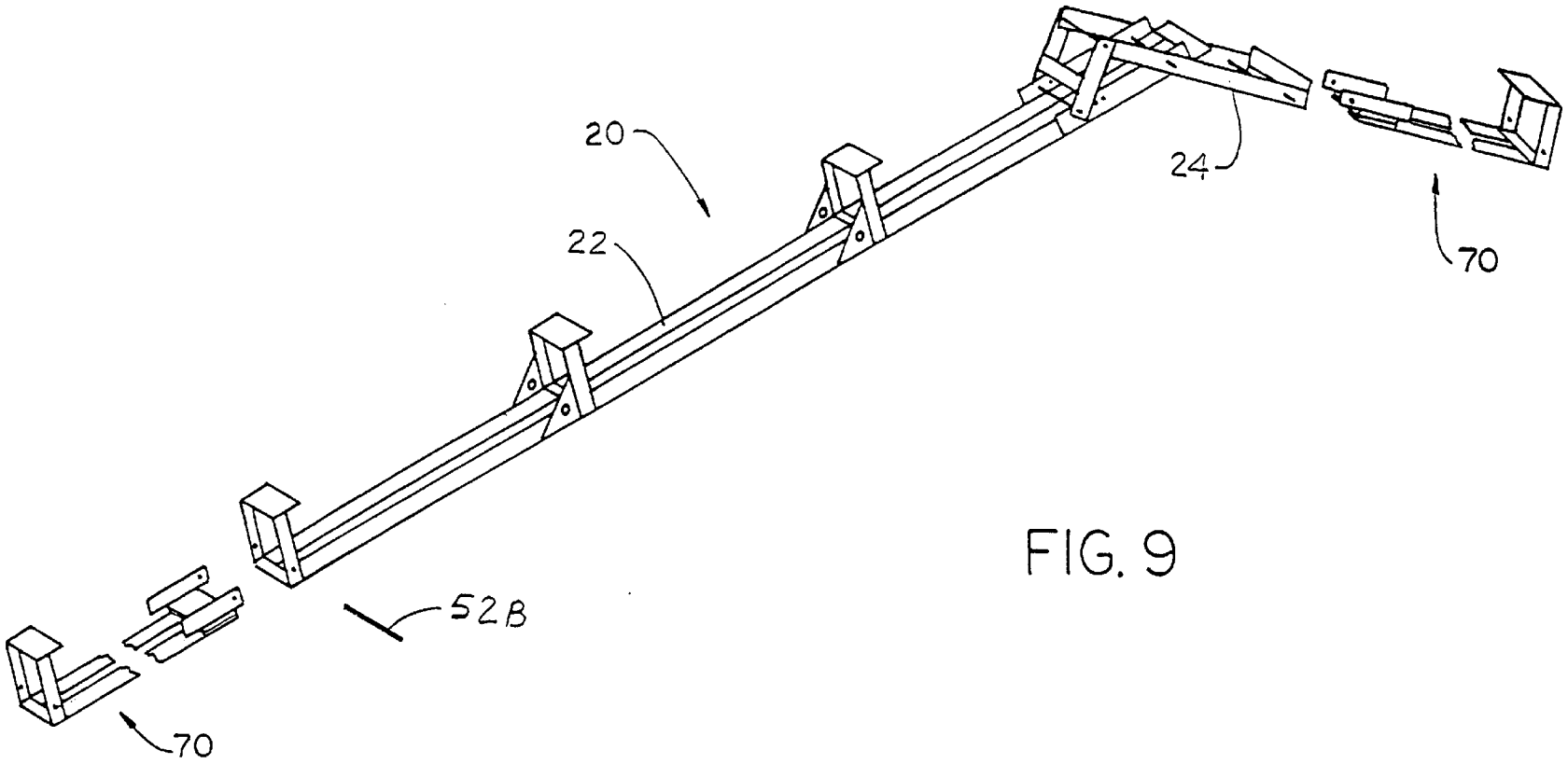
FIG. 9 is a perspective view of the apparatus of this invention including extension assemblies on either end.

Extension assemblies 70 are illustrated in FIG. 9, attached to elongate assembly 20 on both sides of roofpeak 14. Extension assemblies 70, as best shown in FIGS. 7 and 8, include first and second elongate flat pieces 70A and 70B extending along the length thereof. Flat pieces 70A and 70B are similar to flat pieces 22A and 22B and serve like functions, and at least one crosspiece-support member 50 is affixed thereto as previously described with respect to flat pieces 22A and 22B.

Extension assembly 70 includes a top end 70C which is shown in FIGS. 7 and 8. Top end 70C, in addition to portions of flat pieces 70A and 70B, includes an upper-end crosstie 70D affixed to and holding flat pieces 70A and 70B in spaced relationship and first and second connection-support members 70E and 70F affixed to flat pieces 70A and 70B, respectively. First and second connection-support members 70E and 70F include a pair of aligned pin-receiving openings 70G therein which serves to receive and hold securement pin 52B to attach extension assembly 70 to lowermost crosspiece-support member 52—thereby to attach extension assembly 70 to elongate roof-contact member 22.

The parts are dimensioned and arranged so that when extension member 70 is engaged with elongate roof-contact member 22 by alignment of attachment holes, both elongate roof-contact member 22 and extension member 70 are in full contact with the roof, thereby to add stability.

Extension member 70 can be made in any length to accommodate the need to extend the elongate assembly of this invention to a position closer to eave 16A than would otherwise be possible. Extension member 70 can also be used for extension down overpeak side 18 of the roof, in a manner such as hereafter described.

Top end 70C of extension assembly 70 is also configured to mate with attachment pin 24J of overpeak member 24, previously described. More specifically, extension assembly 70 has a pin-receiving slot 70H on it formed between connection support members (70E and 70F) and first and second elongate flat pieces (70A and 70B), and dimensioned to receive attachment pin 24J. The aforementioned offset attachment of distal-end crosspiece 24G of overpeak member 24 and the spacing between first and second overpeak sidepieces 24D and 24E allows engagement of extension assembly 70 between sidepieces 24D and 24E and under crosspiece 24G. Thus, parts are dimensioned and arranged so that, when extension member 70 is engaged with overpeak member 24, both elongate roof-contact portion 24A of overpeak member 24 and extension member 70 are in full contact with the roof, thereby to add stability.

All parts are made of metal, typically metal flat pieces (preferably aluminum) dimensioned as shown in the drawings to have strength while not being excessive in weight. The attachment of metal pieces together (except, of course, for removable pins and rods) is by welding, such that each elongate assembly 20 is sturdy to withstand considerable wear.

Figure 10:
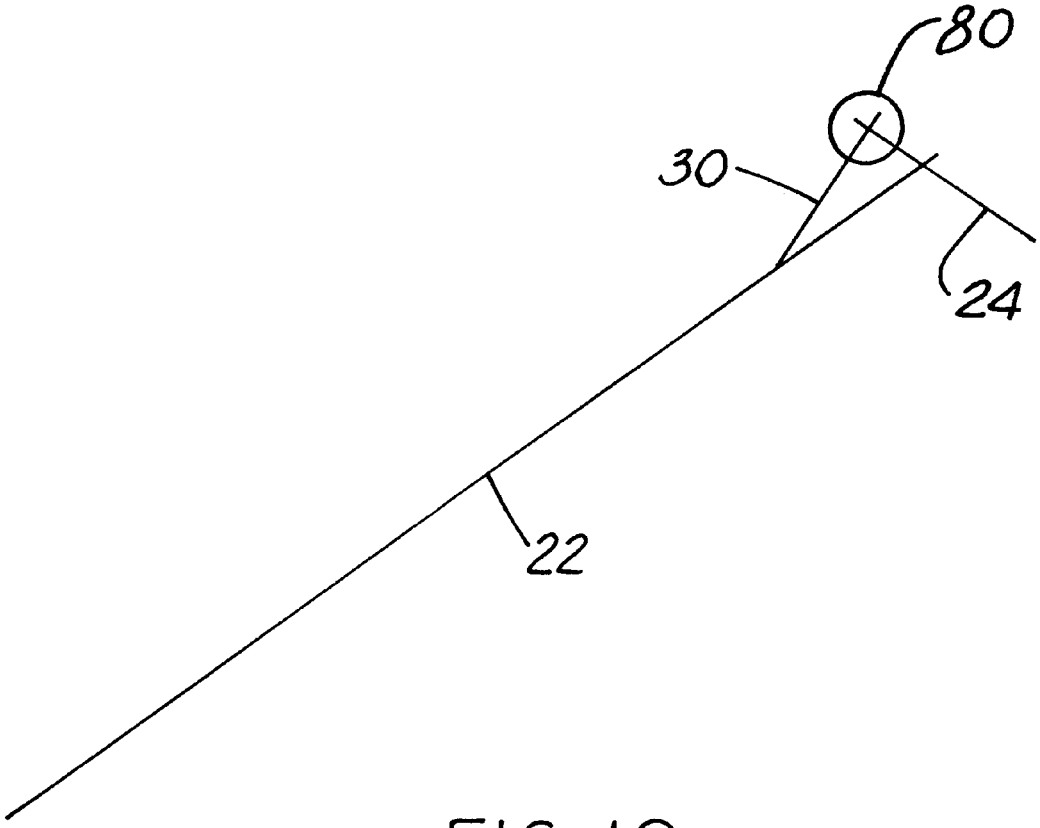
FIG. 10 is a schematic view illustrating a variation of the invention.

FIG. 10 illustrates a variation of the invention in which the elongate roof-contact member further includes a free-wheeling roller 80 which is rotatably mounted on second pivot pin 32. Roller 80 provides a means for facilitating relocation of elongate roof-contact member 22. Such roller is used to support upper portion 20C on the roof during relocation, if desired.

Substantial variation can occur within the spirit of this invention. Variations can be made in attachment of parts, sizes and shapes of parts, pivot attachments, anchors, etc.

While the principles of the invention have been shown and described in connection with specific embodiments, it is to be understood clearly that such embodiments are by way of example and in no way limit the scope of this invention.

I claim:

1. Roofworker support apparatus for placement on slanted roof structures with varying peak angles, comprising:

a pair of elongate assemblies independently deployable on the roof structure in spaced substantially parallel positions extending up the roof, each including:

an elongate roof-contact member having lower, middle and upper portions and a substantially planar roof-contact surface extending therealong;

an overpeak member pivotably secured to the upper portion at a first pivot axis and having roof-contact and free-end portions on opposite sides of the first pivot axis;

an adjustment member having one end secured to the free end and an opposite end secured to the elongate roof-contact member, the securement of the adjustment member being adjustable such that the elongate member and overpeak member can be set at desired angles to accommodate roof peak angles; and at least one crosspiece-support member affixed to the elongate roof-contact member;

a gusset having a first edge engaging the crosspiece-support member and a second edge engaging the roof-contact member, the gusset including a safety harness connection opening therethrough; and at least one elongate crosspiece removably supportable across the elongate assemblies by engagement with the crosspiece-support members, thereby to provide roofworker support at positions between the elongate assemblies.

2. The roofworker support apparatus of claim 1 wherein the adjustment member is pivotably secured to the free end of the overpeak member at a second pivot axis.

3. The roofworker support apparatus of claim 2 wherein the upper portion of the elongate roof-contact member has a plurality of anchorholds thereon for selected securement with the opposite end of the adjustment member.

4. The roofworker support apparatus of claim 3 wherein:

the anchorholds are formed by an anchor member secured to the upper portion of the elongate roof-contact member at a position spaced from the first pivot axis in a direction toward the middle portion, said anchor member having rod-receiving holes spaced therealong; and the opposite end of the adjustment member has a rod transverse to the elongate roof-contact member and engageable in a selected rod-receiving hole.

5. The roofworker support apparatus of claim 1 wherein the roof-contact portion of the overpeak member defines an overpeak roof-contact surface which is substantially planar.

6. The roofworker support apparatus of claim 1 wherein the at least one crosspiece-support member includes a plurality of the crosspiece-support members spaced along the middle and lower portions of the elongate roof-contact member.

7. The roofworker support apparatus of claim 6 wherein one of the crosspiece-support members is a lower-most crosspiece-support member on the lower portion of the roof-contact member, said lowermost crosspiece-support member including an extension-securement member.

8. The roofworker support apparatus of claim 7 further comprising an extension assembly for each elongate assembly, the extension assembly having an extension-roof-contact member extending therealong and a top end attachable to the extension-securement member, thereby to extend down the roof closer to the eave while supported by the elongate assembly.

9. The roofworker support apparatus of claim 8 wherein:

the extension-securement member includes a pin-receiving hole in the lowermost crosspiece-support member and a securement pin therein; and the extension assembly includes a connection-support member at the top end thereof affixed to the extension-roof-contact member, the connection-support member having a pin-receiving opening alignable with the pin-receiving hole while the extension-roof-contact member is in full contact with the roof.

10. The roofworker support apparatus of claim 1 wherein the roof-contact portion of the overpeak member has a distal end portion including an extension-attachment member.

11. The roofworker support apparatus of claim 10 further comprising an extension assembly for each elongate assembly, the extension assembly having an extension-roof-contact member extending therealong and a top end attachable to the extension-attachment member, thereby to extend down the overpeak side of the roof while supported by the overpeak member.

12. The roofworker support apparatus of claim 11 wherein:

the extension-attachment member includes a pin-receiving hole in the distal end portion of the overpeak member and an attachment pin therein; and the extension assembly includes a connection-support member at the top end thereof affixed to the extension-roof-contact member and defining therewith a pin-receiving slot, said slot receiving the attachment pin with the extension-roof-contact member is in full contact with the overpeak side of the roof.

13. The roofworker support apparatus of claim 1 wherein each of the crosspiece-support members includes an upright board support and the crosspiece is a board supported by gravity against the crosspiece-support member and elongate roof-contact member.

14. The roofworker support apparatus of claim 13 wherein at least one of the crosspiece-support members further includes a safety-harness-connection opening therein.

15. The roofworker support apparatus of claim 1 further including a relocation roller rotatably secured to the elongate roof contact member at the upper portion thereof.

16. A roofworker support apparatus for placement on slanted roof structures with varying peak angles, comprising:

a pair of elongated assemblies independently deployable on the roof structure in spaced substantially parallel relationship, each elongated assembly including:

an elongated roof-contact member having first and second generally flat, parallel roof-contact sidepieces interconnected by a crosstie, each roof-contact sidepiece having a height and a width of substantially greater dimension than the height, and further having lower, middle and upper portions, each roof-contact portion including a substantially planar roof-contact surface;

an overpeak member having first and second generally parallel, overpeak sidepieces interconnected by an overpeak crosstie, each overpeak sidepiece pivotably secured to the upper portion of a corresponding roof-contact sidepiece at a first pivot axis and having roof-contact and free-end portions on opposite sides of the first pivot axis;

an adjustment member having first and second generally parallel, adjustment member sidepieces interconnected by an adjustment member crosstie, each adjustment member sidepiece having one end secured to the free end of a corresponding overpeak sidepiece and an opposite end secured to a corresponding elongated roof-contact member, the securement of each adjustment member sidepiece being adjustable such that the elongated member and overpeak member can be set at desired angles to accommodate roof peak angles; and at least one crosspiece-support member affixed to the elongate roof-contact member; and at least one elongated crosspiece removably supportable across the elongated assemblies by engagement with the crosspiece-support members, thereby to provide roofworker support at positions between the elongated assemblies; a gusset having a first edge engaging the cross-piece support member and a second edge engaging one of the roof-contact members.

17. The apparatus of claim 16 wherein the gusset includes a safety harness connection opening extending therethrough.

18. The apparatus of claim 16 wherein the crosspiece-support members include first and second generally parallel, crosspiece-support sidepieces interconnected by a crosspiece-support crosstie to form a crosspiece-support cavity, each crosspiece-support sidepiece having an end secured to a corresponding roof-contact sidepiece.

* * * * *